United States Patent [19]

Kota

[11] Patent Number: 4,815,413

[45] Date of Patent: Mar. 28, 1989

[54] VARNISHING APPARATUS FOR PRINTED SHEET

[75] Inventor: Toshio Kota, Ibaraki, Japan

[73] Assignee: Komori Printing Machinery Co., Ltd., Japan

[21] Appl. No.: 919,144

[22] Filed: Oct. 15, 1986

[51] Int. Cl.[4] ..... B05C 1/02

[52] U.S. Cl. ..... 118/46; 118/249; 118/262

[58] Field of Search ..... 118/46, 231, 262, 249

[56] References Cited

U.S. PATENT DOCUMENTS

| | | | |
|---|---|---|---|
| 4,399,767 | 8/1983 | Simeth | 118/46 |
| 4,524,712 | 6/1985 | Ito | 118/46 |
| 4,569,306 | 2/1986 | Ito | 118/249 |

*Primary Examiner*—John McIntosh

*Attorney, Agent, or Firm*—Remy J. VanOphem

[57] ABSTRACT

A varnishing apparatus for a printed sheet includes: a metering roller, to a peripheral surface of which a varnish from a varnish duct is transferred; a form roller which is brought into contact with a downstream side of the metering roller and is rotated in the same direction as that of the metering roller to allow transfer of the varnish from the metering roller; and a rubber blanket cylinder which is brought into contact with a downstream side of the form roller and is rotated in a direction opposite to that of the form roller to allow transfer of the varnish from the form roller, the rubber blanket cylinder having a notch on its outer peripheral portion and transferring the varnish onto a sheet which is in contact with its peripheral surface. The surface of the metering roller is formed of an elastic material having a roughened surface.

7 Claims, 3 Drawing Sheets

VARNISHING APPARATUS FOR PRINTED SHEET

BACKGROUND OF THE INVENTION

The present invention relates to a varnishing apparatus, arranged between a printing unit and a delivery unit of a rotary press, or in an independent varnishing machine, for varnishing a printed surface of a paper sheet after printing.

A printed surface of a sheet printed by a rotary press is easily contaminated with ink in the following process since the ink dries slowly. In the case of sheets, offset occurs while they are stacked after a delivery operation. In order to prevent this, a drying device can be arranged midway along a conveying path of the printed sheet or spray powder can be sprayed at this position. However, the drying device makes the entire apparatus bulky. On the other hand, when powder is sprayed, the surface of the sheet is roughened causing it to lose its gloss and this often interferes with the following printing. Alternatively, varnish is coated on the printed surface to prevent it from being contaminated and to put a gloss thereon. This is performed mainly for catalogs, pamphlets, and the like, which must have a good appearance.

The varnishing apparatus of this type is sometimes used as an independent varnishing machine. However, in recent years, due to poor work efficiency caused by, e.g., re-stacking of sheets, the varnishing apparatus is normally arranged midway along a delivery path of a rotary press. A typical varnishing apparatus includes a roller group having a roller arrangement similar to that of a dampening device for supplying dampening water to the surface of a printing plate mounted on a plate cylinder of a rotary press. Varnish contained in a varnish duct is supplied to the surface of a rubber blanket cylinder through the roller group, and the varnish is transferred from the rubber blanket cylinder to a sheet passing between the rubber blanket cylinder and an impression cylinder.

However, the rubber blanket cylinder of varnishing apparatus of this type has a notch on its outer periphery portion and the notch corresponds to that for grippers of the impression cylinder. Therefore, a portion, which corresponds to the notch, of varnish to be transferred from the upstream form roller to the rubber blanket cylinder, cannot be transferred and is left on the peripheral surface of the form roller as a thick varnish film. The thick varnish film is moved to the effective surface of the rubber blanket cylinder upon the next rotation, and is then coated on a sheet. Therefore, the varnish film cannot be uniformly coated on the sheet surface between the gripper end and the sheet end, resulting in irregular density in the circumferential direction of a sheet and degrading a product quality.

SUMMARY OF THE INVENTION

It is a principal object of the present invention to provide a varnishing apparatus which can form a uniform varnish film on a rubber blanket cylinder.

It is another object of the present invention to provide a varnishing apparatus which can supply an appropriate amount of varnish, so that a thick varnish film will not be left on a peripheral surface of a form roller.

In order to achieve the above objects, there is provided a varnishing apparatus for a -printed sheet having: a metering roller, to a peripheral surface of which a varnish from a varnish duct is transferred a roller is brought into contact with a downstream side of the metering roller, and is rotated in the same direction as that of the metering roller to allow transfer of the varnish from the metering roller. A rubber blanket cylinder is brought into contact with a downstream side of the form roller and is rotated in a direction opposite to that of the form roller to allow transfer of the varnish from the form roller onto a peripheral surface thereof. The rubber blanket cylinder has a notch on its outer peripheral portion and transfers the varnish onto a sheet which is in contact with its peripheral surface, wherein a surface of the metering roller is formed of an elastic material having a roughened surface.

With the above arrangement, varnish transferred from a varnish duct to a metering roller is transferred to and coated on a sheet through a form roller and a rubber blanket cylinder, and varnish on the form roller facing the notch of the rubber blanket cylinder is not transferred to the rubber blanket cylinder and is left attached to the peripheral surface of the form roller to again face the peripheral surface of the metering roller. However, this varnish is pushed back and flattened by the roughened surface of the metering roller and is circulated while being held in the recessed portion of the roughened surface. Thus, almost no varnish is left on the form roller. Therefore, when the peripheral surface of the form roller faces the rubber blanket cylinder, almost no excess varnish will be transferred to the rubber blanket cylinder except for a normal transfer amount.

BRIEF DESCRIPTION OF THE DRAWINGS

FIGS. 1 to 5 show a varnishing apparatus for a printed sheet according to an embodiment of the present invention, in which:

FIG. 1 is a side view of the apparatus;

FIG. 2 is a schematic side view of a four-color sheet rotary press to which the apparatus of the present invention is applied;

FIG. 3 is an enlarged side view of the main part of FIG. 2;

FIG. 4 is a front view of a metering roller; and

FIGS. 5(*a*) and 5(*b*) are side views for explaining the operation of the rollers.

DETAILED DESCRIPTION OF THE PREFERRED EMBODIMENT

An embodiment of the present invention will now be described with reference to the accompanying drawings.

Figure 2:
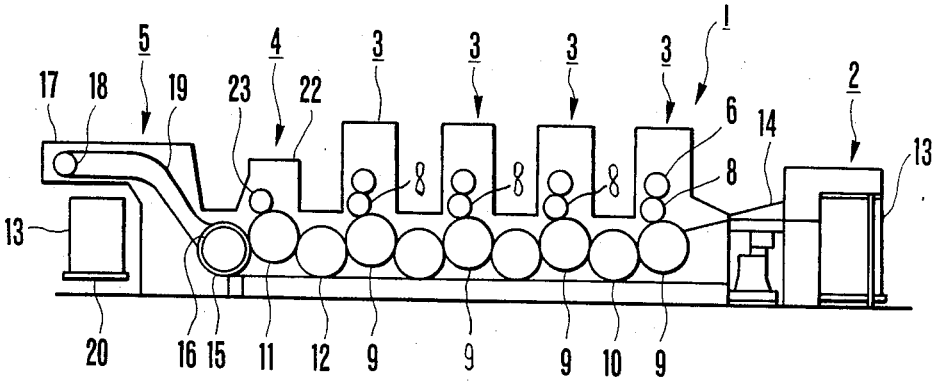
Figure 3:
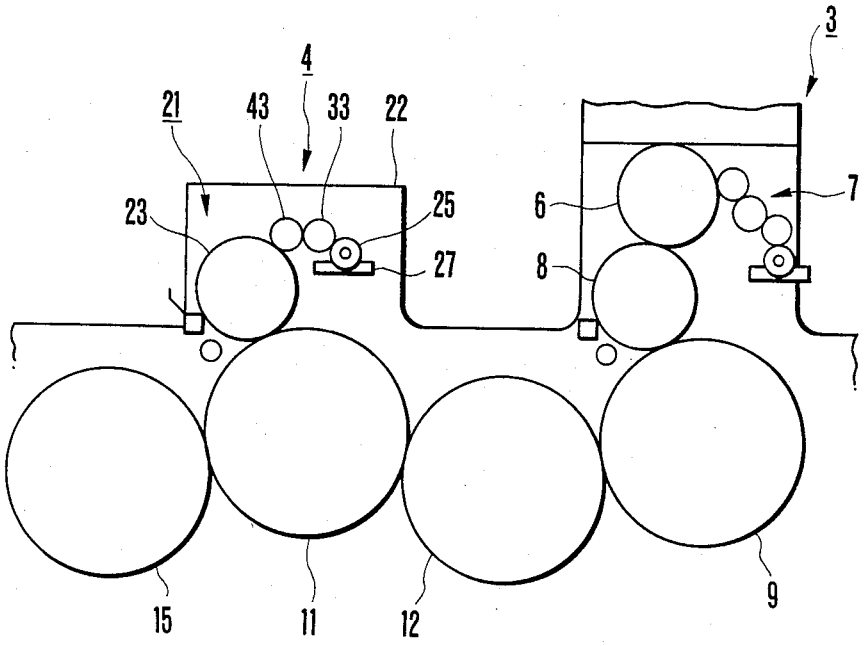

Referring to FIG. 2, a rotary press 1 includes a sheet feeder 2, four-color printing units 3, a varnishing unit 4, and a delivery unit 5. These units are separately assembled and are then combined with each other. Each printing unit 3 has a plate cylinder 6 on the peripheral surface of which a printing plate is mounted, an inking device (not shown) for supplying ink to a printing surface, and a dampening unit 7 for supplying dampening water. The plate cylinder 6 abuts against a rubber blanket cylinder 8 to which an image formed on the plate surface with ink and dampening water is transferred. Each printing unit 3 has an impression cylinder 9 having a diameter twice that of the rubber blanket cylinder 8 to be in contact therewith. In addition, a transfer cylinder 10 having the same diameter as that of the impression cylinder 9 is arranged between adjacent impression cylinders 9 to be in contact therewith. In the varnishing unit 4, an impression cylinder 11 having the same diameter as that of the impression cylinder 9 is arranged at the same level as that of the other impression cylinders. A transfer cylinder 12 is also arranged between the impression cylinder 11 and the impression cylinder 9 for the fourth color. Sheets 13 stacked on a sheet stacker of the sheet feeder 2 are picked up by a sucker device (not shown) one by one, and are fed to a feedboard 14. Thereafter, each sheet is gripped by grippers of the impression cylinder 9 for the first color through a swing device (not shown). During a sheet conveyance the sheet is alternatively gripped by the grippers of the transfer cylinder 10 and the impression cylinder 9, with the result that images of four colors are printed thereon as the sheet passes through each pair of the rubber blanket cylinders 8 and the impression cylinders 9. Then, the sheet is gripped by the grippers of the impression cylinder 11 of the varnishing unit 4 and is wound therearound. The delivery unit 5 includes a delivery cylinder 15 contacting the impression cylinder 11 and a pair of coaxial sprockets 16. A pair of endless delivery chains 19 having a large number of delivery grippers arranged at equal intervals in the direction of travel of the sheet are looped between the sprockets 16 and sprockets 18 at the front end portions of a pair of delivery frames 17. The sheet 13 gripped by the gripper of the impression cylinder 11 is then gripped and conveyed by the grippers of the chains 19 and is released therefrom at the conveying end to be dropped and stacked on a sheet stacker 20.

Figure 1:
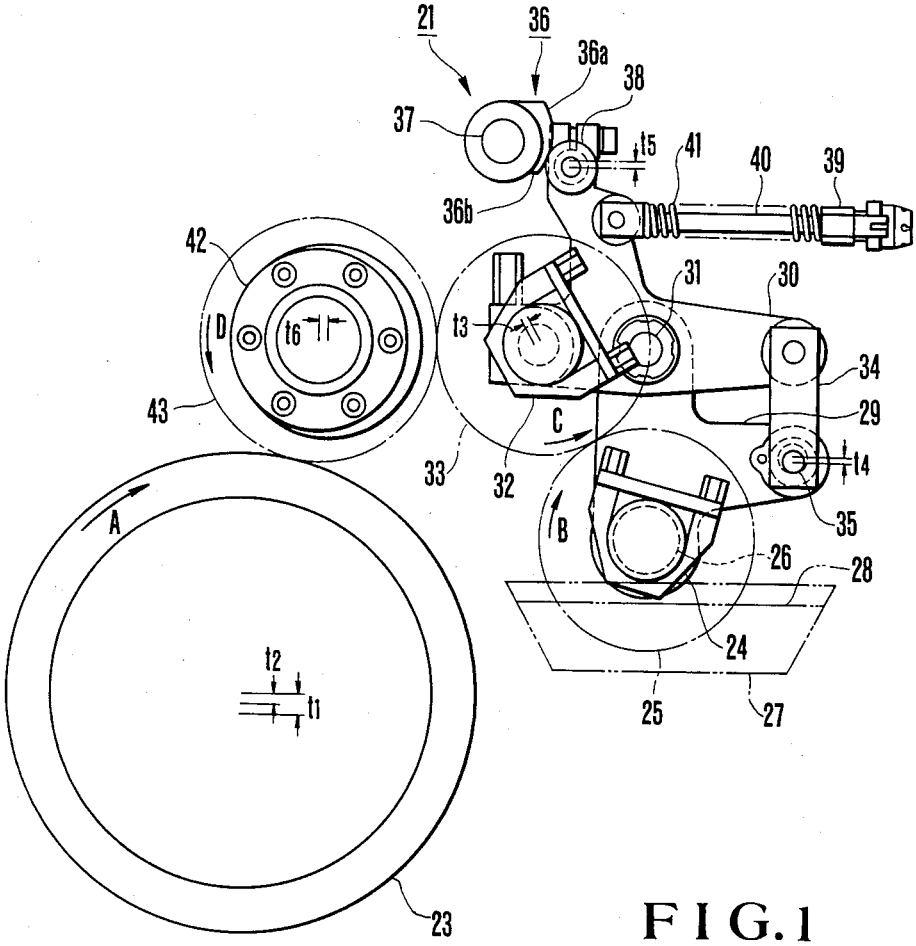

The varnishing unit 4 of the press 1 with the above arrangement includes a varnishing apparatus 21 described below. More specifically, a rubber blanket cylinder 23 which has the same diameter as that of the rubber blanket cylinder 8 and around which a blanket is wound is axially supported by right and left frames 22 through double-structured bearings (not shown). The rubber blanket cylinder 23 is coupled to a motor and is rotated in a direction indicated by arrow A in FIG. 1. The respective outer diameter central axes of double-structured bearings for axially supporting the rubber blanket cylinder 23 are eccentrical with that of the rubber blanket cylinder 23, as indicated by reference symbols $t_1$ and $t_2$. When the bearings are pivoted by an air cylinder an the like, the rubber blanket cylinder 23 can be brought into contact with or removed from the impression cylinder 11, and a contacting pressure between the impression cylinder 11 and rubber blanket cylinder 23 can be adjusted.

Bearings 24 supported to extend inward from the right and left frames 22 rotatably support the two ends of a shaft 26 of a duct roller 25. The duct roller 25 is dipped in a varnish 28 in a varnish duct 27 extending between the frames 22. The duct roller 25 is driven by motor (not shown) through gears and is rotated in a direction indicated by arrow B in FIG. 1. A pair of roller arms 29 are loosely mounted on the shaft portions of the bearings 24 between the end faces of the duct roller 25 and the frames 22. An inverted T-shaped arm 30 is swingably mounted on one free end portion of each roller arm 29 through a pin 31. A bearing 32 having an eccentrical bearing portion as indicated by reference symbol $t_3$ is fixed to one free end portion of each T-shaped arm 30 to allow pivot adjustment. The bearings 32 pivotally support a metering roller 33 so that the peripheral surface of the metering roller 33 abuts against that of the duct roller 25. The metering roller 33 is coupled to the duct roller 25 through gears (not shown), and is rotated in a direction indicated by arrow C in FIG. 1. In addition, when the bearings are pivoted by loosening bolts, a nip pressure between the duct roller 25 and metering roller 33 can be adjusted. One roller arm 29 and one T-shaped arm 30 are coupled to each other through a lever 34 having an eccentrical portion indicated by reference symbol $t_4$ at its one end. When a pin 35 arranged at the eccentrical-portion of the lever 34 is manually pivoted, the metering roller 33 can be brought into contact with or removed from the duct roller 25.

A surface portion 33*a* of the metering roller 33 is formed of an elastic material, e.g., synthetic rubber having a hardness of 20° or higher where "°" indicates the conventional JIS standard for hardness, and a hydrophilic and a hydrophi-lic property. The surface of the elastic material is roughened by a rotary grinder or a buff for grinding. The roughness of the roughened surface 33*a* is set to be 50 to 500% mesh in this embodiment that is, a surface roughness corresponding to a mesh of 50 to 500 lines per inch.

A cam 36 has a large diameter portion 36*a* and a small diameter portion 36*b*, and is fixed to a cam shaft 37 extending between the frames 22. The cam surface of the cam 36 is brought into contact with a roller 38 which is pivotally mounted on the free end portion of each T-shaped arm 30 to allow eccentricity adjustment, as indicated by reference symbol $t_5$. A stud 39 projecting from each frame 22 axially supports a spring shaft 40 which is capable of pivot adjustment and one end of which is pivotally mounted on the T-shaped arm 30. The T-shaped arm 30 receives a pivoting force from a compression coil spring 41 on the spring shaft 40 for pressing the roller 38 against the cam surface of the cam 36. When the cam shaft 37 is pivoted by an air cylinder (not shown), the metering roller 33 is brought into contact with or removed from the duct roller 25 through the cam 36, the roller 38, and the T-shaped arm 30.

An eccentric bearing 42 in which an outer diameter central axis is eccentric from the inner diameter central axis as indicated by reference symbol $t_6$ is arranged above the rubber blanket cylinder 23 to be axially supported by the frames 22. The eccentric bearing 42 axially supports a form roller 43 so that the peripheral surface of the form roller 43 is brought into contact with that of the rubber blanket cylinder 23. When the eccentric bearing 42 is pivoted by an air cylinder (not shown), the form roller 43 is brought into contact with or removed from the rubber blanket cylinder 23. The form roller 43 is coupled to the motor for driving the duct roller 25 through a one-way clutch and gears (neither of which are shown). The form roller 43 can be driven only by the motor to be rotated in a direction indicated by arrow D in FIG. 1.

The operation of the varnishing apparatus 21 with the above arrangement will now be described. When a varnishing operation is performed, the motor for driving the duct roller 25 is started in an impression throw-off state, and the cam 36 is pivoted by the air cylinder. Thus, the roller 38 faces the small diameter portion 36*b* of the cam 36, and the metering roller 33 is pressed against the duct roller 25 and the form roller 43 by the biasing force of the compression coil spring 41. At this time, since the eccentric bearing 42 is pivoted, the form roller 43 is located at a contact position. However, the rubber blanket cylinder 23 is located at its non-contact position upon pivotal movement of its bearing. Therefore, the form roller 43 is separated from the rubber blanket cylinder 23. Rotation of the motor is transmitted to the duct roller 25 and the metering roller 33 through the gears, and is also transmitted to the form roller 43 through the one-way clutch and the gears. Note that the rubber blanket cylinder 23 is separated apart from the impression cylinder 11 and is stopped.

When the respective rollers are rotated, the varnish 28 in the varnish duct 27 is picked up by the duct roller 25, and is transferred to the metering roller 33 while its film thickness is adjusted by the contacting force of the metering roller 43. Thereafter, the varnish 28 is transferred to the form roller 33 and is then circulated between the metering roller 33 and duct roller 25.

When the press is rotated to feed the sheet 13 onto the feedboard 14 by the sheet feeder 2, the sheet 13 is conveyed, and the rubber blanket cylinder 8 of the printing units 3 is thrown on, thus performing four-color printing between the rubber blanket cylinders 8 and the impression cylinders 9. Thereafter, the sheet 13 is conveyed toward the varnishing unit 4. When the sheet 13 reaches the varnishing unit 4, the bearing is pivoted upon instruction from a timing generator to throw on the rubber blanket cylinder 23, so that the rubber blanket cylinder 23 is pressed against the impression cylinder 11 and the form roller 43. Therefore, the varnish circulating between the form roller 43 and duct roller 25 is transferred to the rubber blanket cylinder 23, and is transferred to and coated on the sheet 13 fed between the rubber blanket cylinder 23 and the impression cylinder 11. The varnished sheet 13 is conveyed by the delivery chains 19, and is stacked on the sheet stacker 20. In the impression throw-on state of the rubber blanket cylinder 23, rotation of the motor is kept transmitted to the form roller 43 through the one-way clutch, and the rotation of the rubber blanket cylinder 23 is also transmitted to the form roller 43 through the gears and the other one-way clutch upon throwing-on of the rubber blanket cylinder 23. In this case, since the rotating speed of the rubber blanket cylinder 23 is higher than that of the motor, the rotation is transmitted only by one one-way clutch, and the other one-way clutch is rotated idle.

After the varnishing operation, the sheet-feed operation is stopped, so that the sheet stacker 20 of the delivery unit 5 is exchanged for an empty one, or a paper size is changed, or the blanket is adjusted. Then, the rubber blanket cylinder 8 of the printing units 3 is thrown off and, at the same time, the rubber blanket cylinder 23 of the varnishing apparatus 21 is thrown off with respect to the impression cylinder 11 and the form roller 43. At this time, although the metering roller 33 is kept rotated so as not to solidify the varnish, the explanation of this operation is omitted.

After the above operation or adjustment, the sheet-feed operation is restarted. When the sheet 13 reaches the rubber blanket cylinder 23, the air cylinder is operated at a predetermined timing upon instruction from the timing generator. Then, the roller 38 is pressed against the large diameter portion 36*a* of the cam 36, and the rubber blanket cylinder 23 is thrown on. Therefore, the form roller 43 is urged against the rubber blanket cylinder 23 at a contacting pressure determined by the cam 36 and the roller 38, and is recovered to a varnishing state before the sheet-feed operation is stopped.

Figure 4:
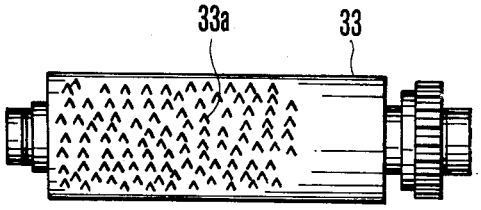
Figure 5A:
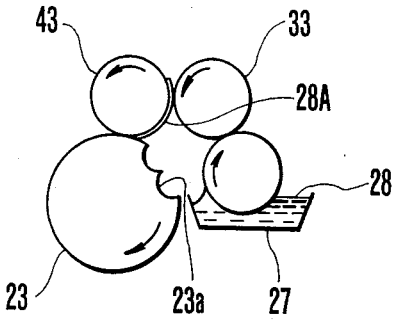
Figure 5B:
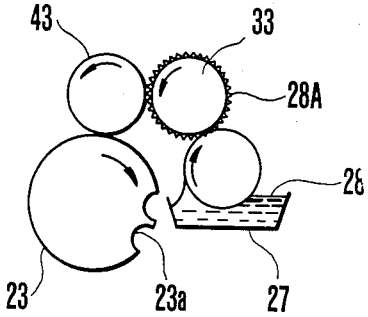

In the varnishing apparatus 21 operated as described above, a notch 23*a* as an ineffective portion corresponding to each of the notches for the grippers of the impression cylinder 11 is formed on the outer peripheral surface of the rubber blanket cylinder 23, as shown in FIG. 5(*a*). By the way, the impression cylinder is twice as large in diameter as the blanket cylinder and is provided with two notches located at diametrically opposite positions. When the rubber blanket cylinder 23 and the form roller 43 are rotated in the directions respectively indicated by arrows A and D, the varnish corresponding to the notch 23*a* is mixed with a new varnish film without being transferred to the rubber blanket cylinder 23 and becomes a thick varnish film 28A. Thus, the varnish film 28A is left on the form roller 43 and passes through the contacting point with the metering roller 33. In this case, in the conventional apparatus described previously, the thick varnish film 28A is left on the form roller 43 and is then transferred to the peripheral surface of the rubber blanket cylinder 23 during the next rotation, thus causing uneven coating. However, in the apparatus of this embodiment, the metering roller 33 and the form roller 43 are rotated in the same direction, and the surface portion 33*a* of the metering roller 33 is roughened, as shown in FIGS. 4 and 5(*b*). Therefore, the thick varnish film 28A to be left on the form roller 43 is pushed backward and flattened by the roughened surface portion 33*a* of the metering roller 33 which is circulated while being in sliding contact with the form roller 43. In addition, since the varnish becomes attached to the metering roller 33 to be held in the recess portion of the roughened surface, it will not be left on the form roller 43. The varnish film 28A returned to the metering roller 33 merges with the varnish 28 picked up by the duct roller 25 and the film thickness is adjusted by the nip pressure therebetween.

Note that the number of rollers and the arrangement thereof are not limited to those in the above embodiment. The metering roller, the form roller, and the rubber blanket cylinder need only be brought into contact with each other in this order from the upstream side, and the number of other rollers and the arrangement thereof can be desirably determined. In the above embodiment, the case has been exemplified wherein the varnishing apparatus is installed in the four-color press. However, the present invention can be applied to any color press or can be independently used.

According to the present invention as described above, in a varnishing apparatus for a printed sheet, a metering roller, a form roller, and a rubber blanket cylinder having a notch on its outer peripheral surface are arranged in this order from a varnish duct, so that their outer peripheral surfaces are brought into contact with each other. The form roller and the rubber blanket cylinder are rotated in opposite directions to sequentially transfer a varnish from the varnish duct. Thereafter, the varnish is transferred to and coated on a sheet contacting the rubber blanket cylinder. Since the surface portion of the metering roller is formed by an elastic material having a roughened surface, when the varnish is transferred between the form roller and the rubber blanket cylinder, the varnish corresponding to the notch of the rubber blanket cylinder is left on the form roller without being transferred to the rubber blanket cylinder. Therefore, even if the varnish left on the form roller is circulated toward the contacting point with the metering roller, it is flattened and pushed back by the metering roller having the roughened peripheral surface and is held in the recess portion of the roughened surface to be left on the metering roller. Therefore, since virtually no varnish is left on the form roller and a fresh film of varnish is supplied to the form roller from the metering roller, uneven coating will not occur on the varnished surface of a printed sheet. In addition, since the varnish can be coated uniformly, product quality of the printed sheet can be greatly improved.

What is claimed is:

1. A varnishing apparatus for a printed sheet comprising:

a varnish duct for containing a varnish;

a metering roller having a roughened peripheral surface portion roughened peripheral surface portion being formed of an elastic material;

transfer means located between said varnish duct and said metering roller for selectively transferring said varnish from said varnish duct to said roughened peripheral surface portion of said metering roller;

a form roller which is selectively in contact with said metering roller, said form roller having a peripheral outer surface, said form roller being rotated in said first direction to allow transfer of said varnish from said roughened peripheral surface of said metering roller to said peripheral outer surface of said form roller;

a rubber blanket cylinder which is selectively in contact with said peripheral outer surface of said form roller, said rubber blanket cylinder having an outer peripheral surface, said rubber blanket cylinder being rotated in a direction opposite said first direction to allow transfer of said varnish from said peripheral outer surface of said form roller onto said outer peripheral surface of said rubber blanket cylinder, said rubber blanket cylinder transferring said varnish onto said printed sheet when said printed sheet is in selective contact with said outer peripheral surface of said rubber blanket cylinder;

means adjacent said metering roller for rotating said metering roller;

means adjacent said form roller for rotating said form roller; and means adjacent said rubber blanket cylinder for rotating said rubber blanket cylinder.

2. An apparatus according to claim 1, wherein said elastic material is synthetic rubber having a hardness of not less than 20° and a hydrophilic property.

3. An apparatus according to claim 1, wherein said roughened peripheral surface of said metering roller is formed by a rotary grinder disk.

4. An apparatus according to claim 3, wherein said roughened peripheral surface of said metering roller has a roughness of 50 to 500 lines per inch.

5. An apparatus according to claim 4, wherein said varnishing apparatus is connected to a four-color rotary press and said printed sheet is provided by said four-color rotary press.

6. An apparatus according to claim 1, wherein said roughened peripheral surface is formed by buffing.

7. An apparatus according to claim 1, wherein said means for rotating said metering roller includes means for selectively transferring said varnish from said peripheral outer surface of said form roller to said outer peripheral surface of said rubber blanket cylinder.

* * * * *

UNITED STATES PATENT AND TRADEMARK OFFICE

CERTIFICATE OF CORRECTION

PATENT NO. : 4,815,413

DATED : March 28, 1989

INVENTOR(S) : Toshio Kota

It is certified that error appears in the above-identified patent and that said Letters Patent is hereby corrected as shown below:

Column 1, line 56, after "degrading" delete "a".

Column 1, line 67, after "a" (second occurrence) delete hyphen "-".

Column 1, line 67, after "having" delete colon ":".

Column 2, line 1, after "transferred" insert a period ----. ----; same line, delete "a" (second occurrence) and insert ---- A form ----.

Column 3, line 27, delete "gripper" and insert ---- grippers ----.

Column 3, line 55, after "by" insert ---- a ----.

Column 4, line 17, delete "and a hydrophi-lic".

Column 4, line 20, delete percent sign "%" and insert ---- # ----.

Column 5, line 13, delete "43" and insert ---- 33 ----.

UNITED STATES PATENT AND TRADEMARK OFFICE

CERTIFICATE OF CORRECTION

PATENT NO. : 4,815,413

DATED : March 28, 1989

INVENTOR(S) : Toshio Kota

It is certified that error appears in the above-identified patent and that said Letters Patent is hereby corrected as shown below:

Column 5, line 14, delete "33" and insert ---- 43 ----.

Column 7, line 12, after "portion" (first occurrence) insert ----, said metering roller being rotated in a first direction, said ----.

Signed and Sealed this

Thirteenth Day of February, 1990

*Attest:*

JEFFREY M. SAMUELS

*Attesting Officer* *Acting Commissioner of Patents and Trademarks*